US009981152B2

(12) United States Patent
Fiskaa

(10) Patent No.: US 9,981,152 B2
(45) Date of Patent: May 29, 2018

(54) EVACUATION DEVICE

(71) Applicant: SEES AS, Fiska (NO)

(72) Inventor: Trond Fiskaa, Fiska (NO)

(73) Assignee: SEES AS, Fiska (NO)

( * ) Notice: Subject to any disclaimer, the term of this patent is extended or adjusted under 35 U.S.C. 154(b) by 0 days. days.

(21) Appl. No.: 15/316,250

(22) PCT Filed: Jun. 4, 2015

(86) PCT No.: PCT/NO2015/050100
§ 371 (c)(1),
(2) Date: Dec. 5, 2016

(87) PCT Pub. No.: WO2015/187035
PCT Pub. Date: Dec. 10, 2015

(65) Prior Publication Data

US 2017/0151454 A1 Jun. 1, 2017

(30) Foreign Application Priority Data

Jun. 5, 2014 (NO) ..... 20140707

(51) Int. Cl.
*A62C 35/58* (2006.01)
*A62C 2/06* (2006.01)
(Continued)

(52) U.S. Cl.
CPC ..... *A62C 35/58* (2013.01); *A62C 3/14* (2013.01); *A62C 37/36* (2013.01); *A62C 99/009* (2013.01);
(Continued)

(58) Field of Classification Search
CPC ..... A62C 3/14; A62C 35/58; A62C 37/36; A62C 99/0072; A62C 99/009; F04F 5/16; F04F 5/20; F04F 5/462
See application file for complete search history.

(56) References Cited

U.S. PATENT DOCUMENTS 4,616,694 A * 10/1986 Hsieh ..... A62B 13/00 165/47
4,655,692 A 4/1987 Ise
(Continued)

FOREIGN PATENT DOCUMENTS

CA 2 861 760 A1 7/2013
DE 26 55 308 A1 6/1978
(Continued)

OTHER PUBLICATIONS

International Search Report, dated Oct. 7, 2015, from corresponding PCT application.
(Continued)

*Primary Examiner* — Christopher Kim
(74) *Attorney, Agent, or Firm* — Young & Thompson

(57) ABSTRACT

An evacuation device (1) for transporting gas and/or particles out of a room includes mounting elements (7, 9) for installation in a wall (3) of the room such that an inflow end (6) is located on the face of the wall (3) that faces the inside of the room and an outflow end (8) is located outside the room. The evacuation device includes a duct (2) extending between the inflow end and the outflow end, and a barrier (12) is releasably attached in the duct to seal it when the evacuation device is in a standby state. Driving elements (21) are arranged to guide at least one flow of fluid through the duct when the evacuation device is in an activated state. Preferably, the duct includes a venturi nozzle, and the driving elements include a number of water nozzles located upstream of the inflow end of the venturi nozzle.

19 Claims, 6 Drawing Sheets

(51) Int. Cl.

| | |
|---|---|
| ***A62C 37/36*** | (2006.01) |
| ***F04F 5/46*** | (2006.01) |
| ***F04F 5/16*** | (2006.01) |
| ***F04F 5/20*** | (2006.01) |
| ***A62C 99/00*** | (2010.01) |

(52) U.S. Cl.
CPC ..... *F04F 5/16* (2013.01); *F04F 5/20* (2013.01); *F04F 5/462* (2013.01); *A62C 99/0072* (2013.01)

(56) References Cited

U.S. PATENT DOCUMENTS

| | | | | |
|---|---|---|---|---|
| 5,957,212 | A * | 9/1999 | Randholm | A62C 3/10 169/16 |
| 6,805,203 | B2 * | 10/2004 | Retzloff | A62C 37/09 169/37 |
| 2016/0102682 | A1 * | 4/2016 | Gass | F04F 5/20 417/179 |
| 2016/0144212 | A1 * | 5/2016 | Hurme | A62C 5/008 169/46 |

FOREIGN PATENT DOCUMENTS

| | | | |
|---|---|---|---|
| GB | 2 473 424 | A | 3/2011 |
| KR | 200475358 | Y1 | 11/2014 |
| NO | 20111013 | A1 | 1/2013 |
| WO | 2014037610 | A1 | 3/2014 |

OTHER PUBLICATIONS

Supplemental European Search Report dated Jan. 22, 2018, in corresponding European application 15 80 3682.

* cited by examiner

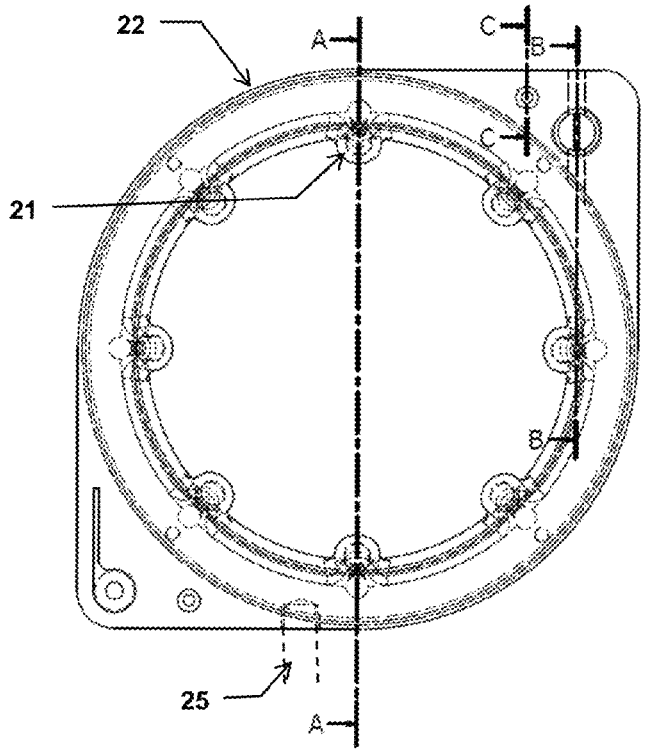
Fig. 9
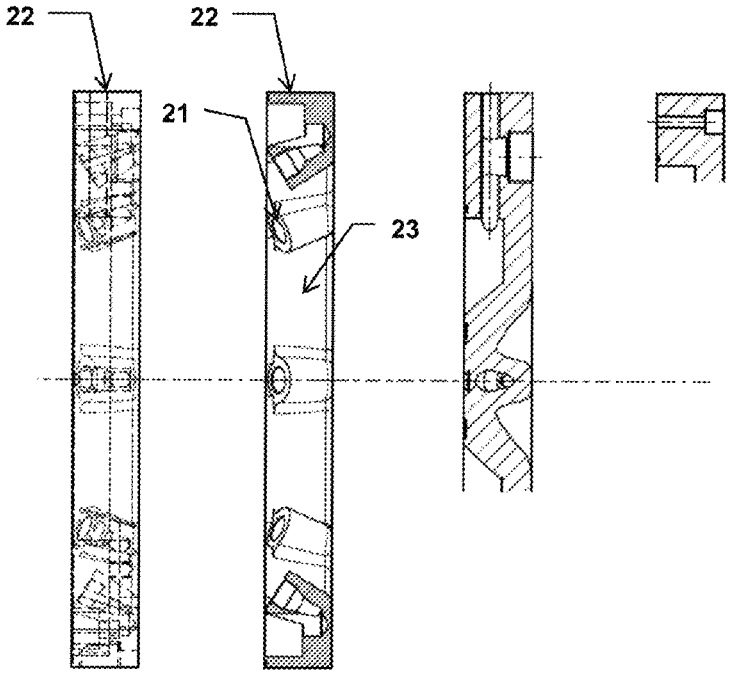
Fig. 10 (a) (b) (c) (d)

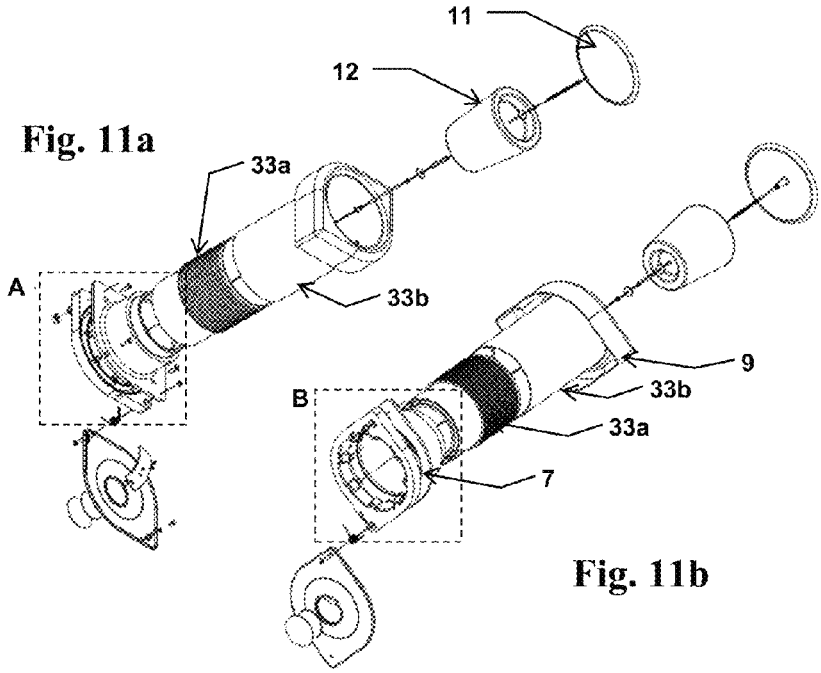
Fig. 11a
Fig. 11b
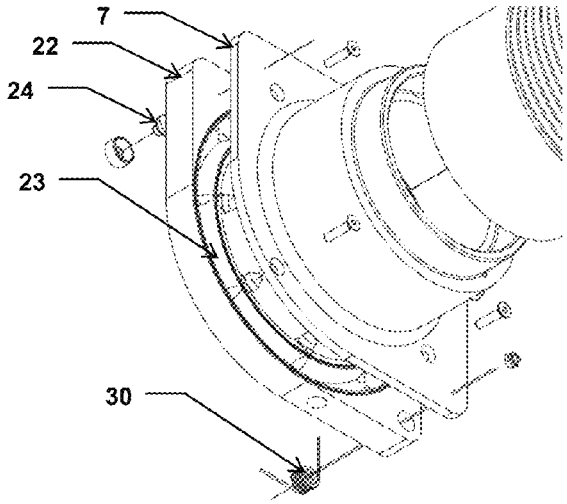
Fig. 12a
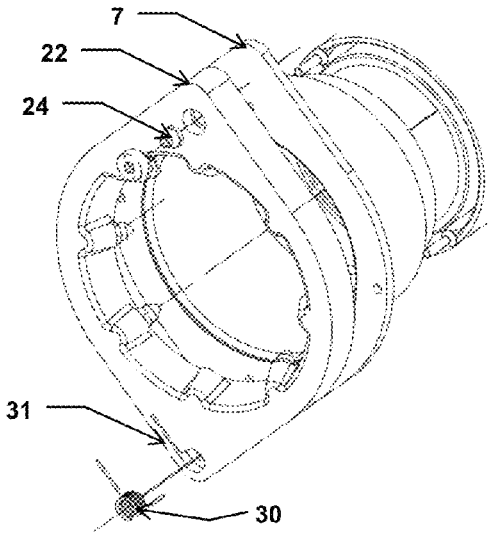
Fig. 12b

EVACUATION DEVICE

FIELD OF THE INVENTION

The invention relates to devices for extinguishing fires and removing gases. More precisely, the invention relates to an evacuation device as indicated in the preamble of independent claim 1.

BACKGROUND OF THE INVENTION

Various devices and systems for fighting fires are known. NO 20111013 describes a system for extinguishing fires that have broken out. The system draws out incendiary fumes that gather under the ceiling as the flames flare up. A thermostat activates and deactivates the system at given temperatures, or by a crew after they have inspected and secured the site of the fire. Water or gas in liquid form flows out of a nozzle, backwards inside an evacuator, out of the room and down the drain or other system. Negative pressure is created, which causes the gas to be transported out.

The present invention is an improvement of this prior art and introduces in addition other advantages.

SUMMARY OF THE INVENTION

The invention is described in and characterised by the independent claim, whilst the dependent claims present other characteristics of the invention.

Thus, there is provided an evacuation device for transporting gas and/or particles out of a room, comprising mounting means for installation in a wall of the room such that an inflow end is located on the face of the wall that faces the inside of the room and an outflow end is located outside the room, the evacuation device comprising a duct extending between the inflow end and the outflow end, characterised by a barrier releasably attached in the duct to seal it when the evacuation device is in a standby state, and driving means arranged to guide at least one flow of fluid through the duct when the evacuation device is in an activated state.

In an embodiment, the duct comprises a venturi nozzle with an inflow portion, an outflow portion and an intermediate tapered portion, the inflow portion being in fluid communication with the inflow end and the outflow portion being in fluid communication with the outflow end. In an embodiment, the driving means are located upstream of the tapered portion. The driving means may be located upstream of and in an area near the inflow end, at the entrance to the inflow portion of the venturi nozzle.

In an embodiment, the driving means comprise one or more nozzles arranged for connection to a liquid reservoir and configured to send nebulized liquid into the duct. The driving means may comprise a plurality of water vaporizing nozzles placed in a holder at the inflow to the inflow portion, the water nebulizing nozzles being arranged for fluid communication with a water reservoir.

In an embodiment, the evacuation device comprises an inflow lid for releasably shutting off the inflow end and an outflow lid for releasably shutting off the outflow end when the evacuation device is in a standby state, and activating means to release the inflow and outflow lids when the evacuation device is brought into an activated state. The activating means may comprise a pressure-actuated plug arranged to be able to be moved by applying pressurised water.

In an embodiment, the barrier comprises an isolating plug adapted to sealingly engage the outflow portion of the venturi nozzle. The evacuation device comprises further attachment means for releasable connection of the outflow lid, the barrier and the inflow lid.

Also provided is a system for extinguishing a fire in a room, characterised by an evacuation device according to the invention and a water nebulizing nozzle, the evacuation device and the water nebulizing nozzle both being placed in a wall and in fluid communication with a water reservoir, and having associated temperature and/or smoke sensor means, the water reservoir being associated with receiver means arranged for communication with the sensor means with a control unit for the water supply to the evacuation device and the water nebulizing nozzle.

BRIEF DESCRIPTION OF THE DRAWINGS

The aforementioned and other characteristics of the invention will be further explained in the following description of a preferred embodiment, presented as a non-limiting example, with reference to the attached drawings, wherein:

FIG. 9 is a partly see-through front view of the nozzle holder;

FIG. 10*a* is a partly see-through side view of the nozzle holder shown in FIG. 9;

FIGS. 10*b,c,d* are sectional views seen in the direction of the sectional lines A-A, B-B, C-C, respectively, of FIG. 9;

FIGS. 11*a* and 11*b* are perspective views of the evacuation device in a non-mounted state;

FIG. 12*a* is an enlarged view of the region designated with A in FIG. 11*a* and FIG. 12*b* is an enlarged view of the region designated with B in FIG. 11*b;*

DETAILED DESCRIPTION OF A PREFERRED EMBODIMENT

Figure 1:
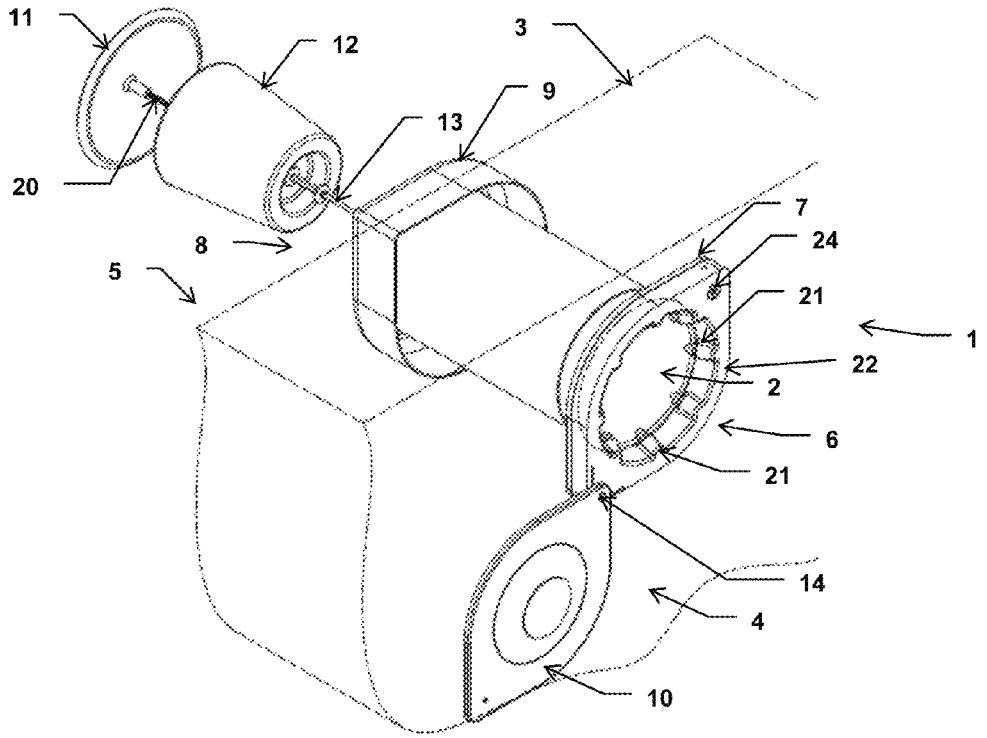
FIG. 1 is a perspective view of an embodiment of the evacuation device according to the invention mounted in a wall and in an activated state.
Figure 2:
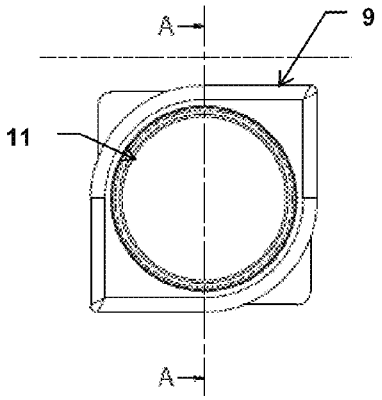
FIG. 2 shows the evacuation device of FIG. 1 in a standby state seen from an outflow end.
Figure 3:
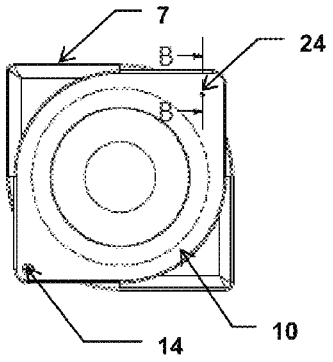
FIG. 3 shows the evacuation device of FIG. 1 in a standby state seen from an inflow end.

Referring to FIGS. 1-3, in the embodiment illustrated, the evacuation device 1 according to the invention comprises a duct 2 which, when the evacuation device is mounted in a wall 3, is arranged to lead gases from a wall face 4 to another wall face 5 in a way that will be described in the following. The first wall face 4 may for example be a wall of a room, and therefore, in the following, it will also be referred to as an inner side 4. Consequently, the other wall face 5 may hereinafter also be referred to as an outer side 5. It shall be understood that the inner side and the outer side do not necessarily have to be faces of the same wall, and that there might be a room in between through which the duct passes. The inflow end 6 of the duct is attached to the inner side by an inner fitting 7, and the outflow end 8 of the duct is attached to outer side by an outer fitting 9. Attachment of these fittings to the wall is done in an essentially known manner and will thus not be described in more detail.

The inflow end 6, where the gases are drawn in when the evacuation device is in an activated state, is provided with an inflow lid 10 pivotably mounted to the inner fitting 7. The outflow end 8, where the gases are discharged when the evacuation device is in an activated state, is provided with an outflow lid 11. The outflow lid 11 is connected to an isolating plug 12 via a spring 20 and a rod 13, in a way that will be described below.

FIG. 1 shows the evacuation device in an activated state, i.e. the inflow lid 10 is pivoted (about the pivot pin 14) into an open position and the isolating plug 12 and the outflow lid 11 are removed from the evacuation device, so that the duct 2 is open. FIGS. 2 and 3 show the evacuation device in a standby state, seen from the outflow end (outer side) and the inflow end (inner side), respectively, and show the outflow lid 11 and the inflow lid 10, respectively, in closed positions, so that the duct is closed.

Figure 4:
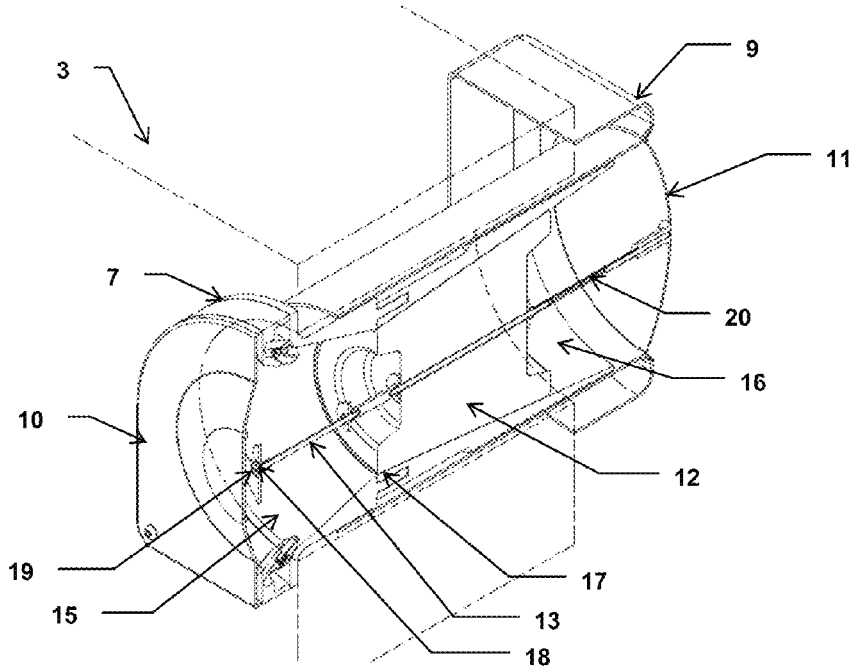
FIG. 4 and FIG. 5 are perspective views of the evacuation device along the sectional line A-A of FIG. 2.
Figure 5:
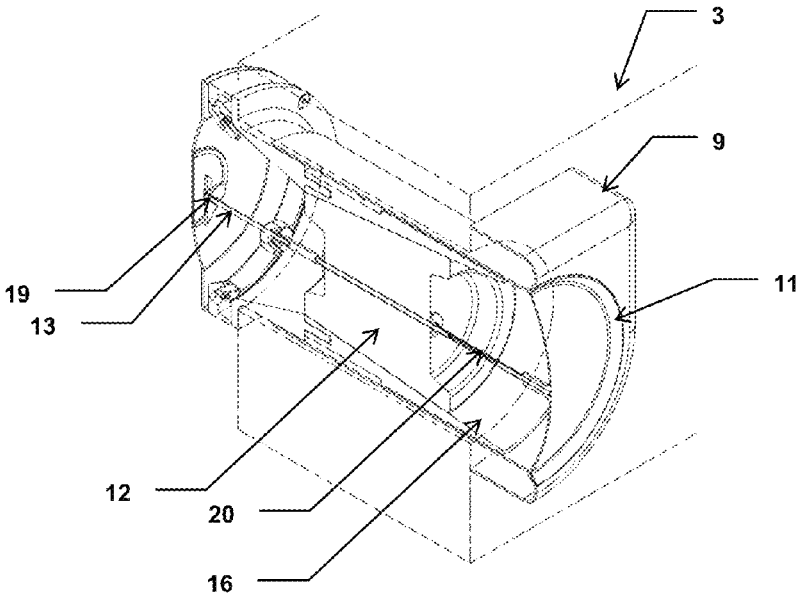

Reference will now be made to FIGS. 4 and 5, which both show the evacuation device 1 mounted in a wall 3 and in a standby state. These figures also show that the internal shape of the duct 2 is formed like a venturi nozzle, with an inflow portion 15, an outflow portion 16 and an intermediate tapered portion 17. The isolating plug 12 has a truncated cone shape such that it fits into the outflow portion 16 of the venturi nozzle. The above-mentioned rod 13 passes through the isolating plug 12 and is fixed thereto. One end (the inner end) of the rod has a head 18 that in the position shown is attached to a fitting with a V-shaped groove 19. The fitting with the V-shaped groove is attached to the inflow lid 10 or is an integrated part thereof. The length of the rod 13 between the head 18 and the isolating plug 12 is adapted to the axial length of the inflow portion 15, so that the isolating plug is held in place as shown in FIGS. 4 and 5 by the engagement between the head 18 and the groove 19. This way, the isolating plug 12 seals off the duct 2, and since it is formed of a sound and air isolating material, it isolates the inner side 4 and the outer side 5 from one another.

On the other side of the isolating plug 12, the rod 13 is connected to one end of a spring 20. The other end of the spring 20 is connected to the outflow lid 11. The length of the spring 20 and its spring constant is adapted in such a way that the spring 20 is extended when it is mounted as shown in FIGS. 4 and 5. Thus, in the standby state of the evacuation device, the outflow lid 11 is pulled towards the outer fitting 9 by means of the biasing force of the spring 20.

When the evacuation device is activated (in a way that will be described below), the inflow lid 10 is pivoted about the pivot pin 14 to an open position shown in FIG. 1. By this pivoting movement, the V-shaped groove 19 is moved away from the head 18, so that the rod 13 is released at that end. Since the rod 13 is now uncoupled at its inner end, the stored biasing force of the spring 20 will pull the isolating plug 12 towards the outflow lid 11, so that both, the isolating plug 12 and the outflow lid 11, are released from the evacuation device (as shown in FIG. 1) and will in practice fall down. That way, the duct is opened 2.

Figure 6:
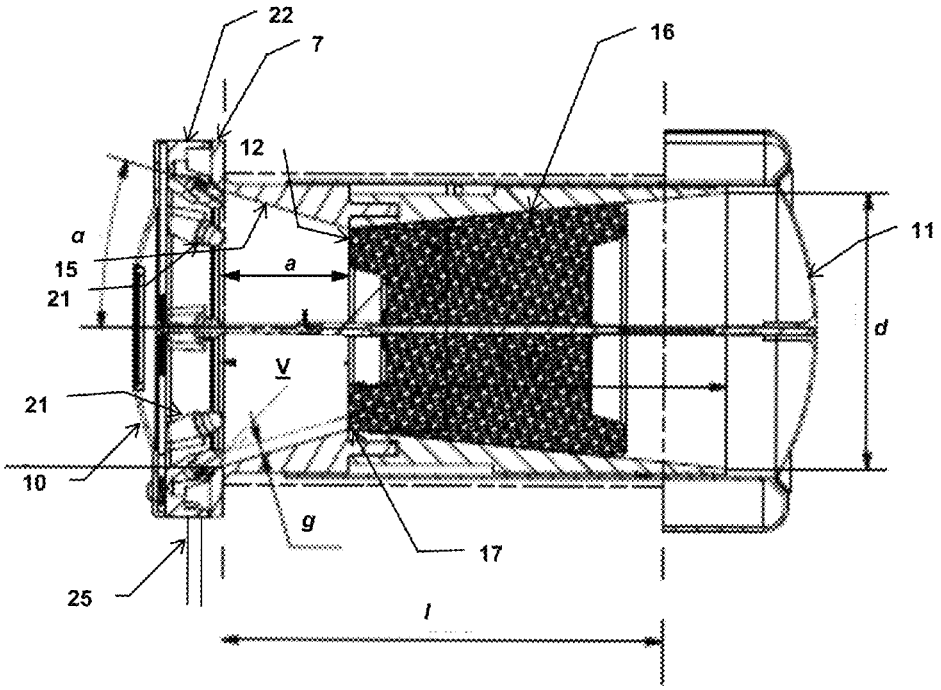
FIG. 6 is a sectional view seen in the direction of the sectional line A-A of FIG. 2.

Additional reference is now made to FIG. 6, which also shows the evacuation device in a standby state, with the isolating plug 12 in place in the outflow portion 16 of the venturi nozzle and the inflow and outflow lids 10, 11 in place at the respective ends. A number of nozzles 21 is arranged in a nozzle holder 22 mounted to the inner fitting 7 at the inflow end 6, such that the nozzles are placed in a ring around the inflow end before the inflow end 15 of the venturi nozzle, as it also is depicted in e.g. FIG. 1. The nozzles, which are of an essentially known type, are connected to a reservoir (not shown) and are arranged to inject a liquid (e.g. nebulized water) into the inflow portion 15. The center line of the nozzles 21 is preferably parallel to the surface (wall) of the inflow portion 15 and at a distance g therefrom. In this way, the water comes out of the wall. In the embodiment shown in FIG. 6, the angle $\alpha$ of the inflow portion 15 is 16, 7°, the diameter d is 220 mm, the length l of the venturi nozzle is 400 mm, the distance a between the tapered portion 17 and the outflow opening 23 of the nozzles 21 is 100 mm, and g is 10 mm.

Figure 8A:
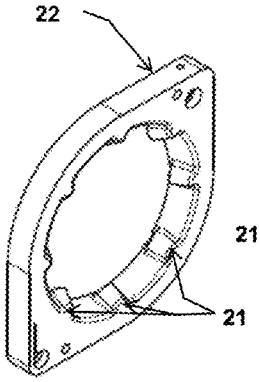
FIG. 8*a* and FIG. 8*b* are perspective views of the nozzle holder seen from the front and from behind, respectively.
Figure 8B:
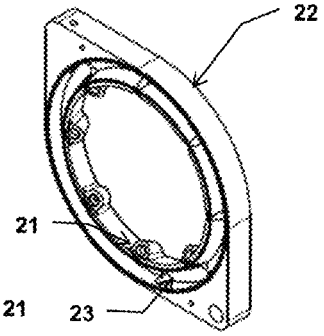

As is shown in FIG. 8*b*, the nozzles 21 are supplied with a liquid (preferably water) via a supply duct 23 arranged in the nozzle holder 22. The supply duct 23 may be connected to an external water reservoir (not shown in FIG. 8*b*) via an inlet 25 (see e.g. FIGS. 6, 9, 13), such as a firefighting water supply system with an appropriate pressure regulator of known type. The supply duct 23 is also shown in FIGS. 9 and 10*a-c*.

Figure 7:
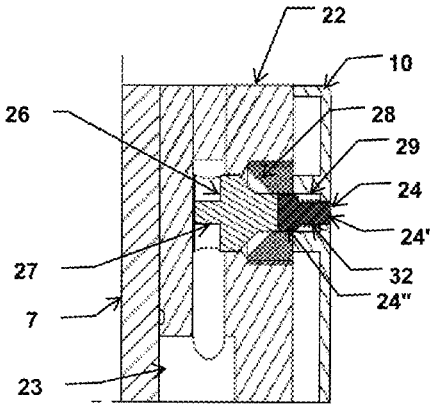
FIG. 7 is a sectional view seen in the direction of the sectional line B-B of FIG. 3.

Activation of the evacuation device, i.e. the transition from a standby state to an activated state, will now be described. As mentioned in the above, the inflow lid 10 is pivotable about the pivot pin 14. When the evacuation device is in its standby state, the inflow lid 10 is held in place in its closed position by means of the locking pin 24, which prevents the inflow lid from pivoting. With particular reference to FIG. 7 (which shows the evacuation device in its standby state), an outer end 24' of the locking pin 24 extends through a hole in the inflow lid 10. A compression spring 32 is shown supported by the locking pin. This compression spring is optional, and if it is used, it must not be as rigid as to obstruct a smooth axial movement of the locking pin. The locking pin 24 is provided with a head 24" that extends into the nozzle holder 22 and abuts an activating plug 26 lying at the back. The activating plug 26 has an overhanging portion 27 which extends into and blocks the inflow 25. When the evacuation device is to be activated, pressurised water is led into the supply duct 23. This water impinges on the overhanging portion 27 and the remaining part of the activating plug 26 that is exposed to the water, and pushes the activating plug 26 against the head 24" of the locking pin (to the right in FIG. 7). The activating plug 26 moves until it hits a seat 28. The movement of the activating plug pushes the head 24" of the locking pin into a complementary shaped recess 29 in the inflow lid 10, whereupon the locking pin 24 is released from the nozzle holder 22 and the inflow lid 10 can rotate about the pivot pin 14. At the same time, water flows in the supply duct 23 and further through the nozzles 21, into the inflow portion 16 and through the venturi nozzle. This nebulized water flow through the venturi nozzle also contributes to pushing the isolating plug 12 out of the evacuation device, in case the isolating plug at this time has not yet been fully removed in the way described above.

When the evacuation device is mounted to a wall, the inflow lid 10 may fall (rotate) down into the open position (which is shown in FIG. 1) by means of its own weight. To remedy this rotational movement, the embodiment illustrated is provided with a rotational spring 30 placed in a complementary groove 31, as shown e.g. in FIGS. 12*a* and 12*b*.

Thus, the evacuation device, in a standby state, is passive and is not under constant water pressure as is the case in conventional fire extinguishing devices. Water is supplied to the supply duct 23 only when a valve (not shown) further upstream in the water supply, e.g. in or near a pressure regulator (not shown) is opened upon receipt of sensor signals (from smoke- and/or temperature sensors) or a manual signal. If desirable, a vacuum may be established in the space V when the evacuation device is in its standby state.

FIGS. 11*a* and 11*b* show a variant of the evacuation device according to the invention, where two telescopic tubes 33*a,b* are arranged between the fittings 7, 9. One of the telescopic tubes 33*a* forms essentially the outer side of the outflow portion 16 of the venturi nozzle. The evacuation device can thus be adapted to the actual wall thickness on site during installation. Mounting in the wall is done in an essentially known manner by using attachment means, sealing compounds, insulating foams and the like as required.

Figure 13:
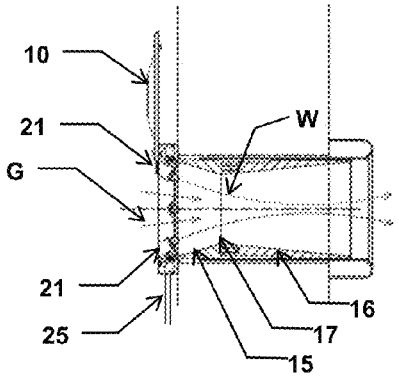
FIG. 13 illustrates the flow through the evacuation device in an activated state.

FIG. 13 shows the evacuation device in an activated state and in operation. Water W is ejected from the nozzles 21 which are located by the inflow to the inflow portion 15 of the venturi nozzle, as described above. Water is preferably ejected in the form of droplets, as nebulized water. A droplet size of 0.5 mm has proven appropriate. As the nebulized water mixed with the surrounding air passes through the inflow portion 15 of the venturi nozzle, the tapered portion 17 and the outflow portion 16, the mixture of gas and nebulized water is accelerated by the venturi nozzle, and negative pressure is created at the inflow portion 15 of the venturi valve and upstream thereof. This venturi effect causes gases (air, smoke, etc.) and suspended particles upstream of the venturi nozzle, i.e. upstream of the duct 2 and the inflow end 6 of the evacuation device, to be drawn in and through the evacuation device. In addition, the vaporized water binds particles (e.g. soot) and contributes to cooling the gases that pass through the evacuation device.

For two variants of the evacuation device, calculations were made with the following dimensions and operating parameters:

Droplet size: 0.5 mm.

Water temperature in: 8° C.

Nozzle mouth distance from venturi nozzle wall (g): 10 mm.

Upstream air temperature (at the entrance to the inflow portion): 500° C.

| | Var. 1 | Var. 2 |
|---|---|---|
| Diameter, d (mm) | 220 | 160 |
| Length, l (mm) | 400 | 300 |
| Number of nozzles | 8 | 4 |
| Water supply (liter/min) | 50 | 25 |

Calculations for the two different nozzle configurations show the following:

| | Var. 1 | Var. 2 |
|---|---|---|
| Air/gas transport through the evacuation device: (liter/sec) | 730 | 300 |
| Air/gas temperature at the outflow of the outflow portion (° C.) | 316 | 382 |

The calculations show that arranging the nozzles in that manner (before the inflow portion, nozzle mouths oriented in parallel with the wall of the inflow portion and at a distance therefrom) brings about a very good suction effect and cooling effect, and an optimum (long) evaporation length.

Figure 14:
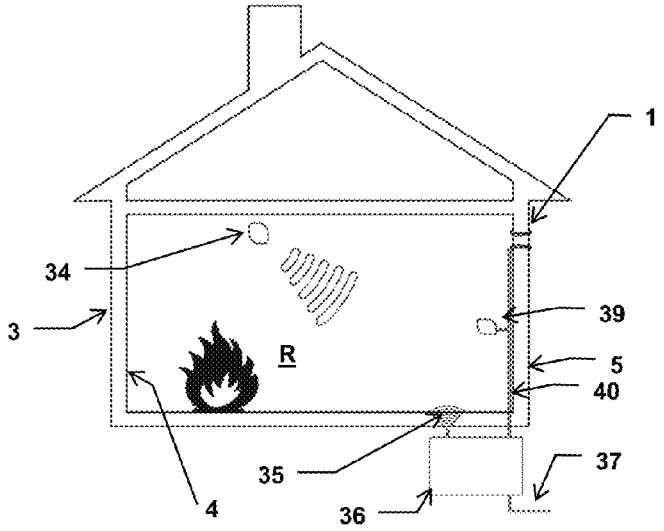
FIG. 14 is a pictorial schematic of the evacuation device according to the invention mounted in a wall and associated with a nebulizing device, sensors and a water supply to a system for evacuating smoke and fighting fire.

FIG. 14 shows the evacuation device 1 mounted in a wall 3 and associated with a nebulizing device 39 (which may be a water nebulizing nozzle of essentially known type). The evacuation device and the nebulizing device are both connected to a water reservoir 36 (with valve and pressure regulator, not shown) and a supply conduit 37. A pipe 40 connected to the inflow of the evacuation device extends from the water reservoir. A fire- and/or smoke sensor 34 of an essentially known type is located on the ceiling of the room R and communicates with a receiver 35 at the water reservoir. When a fire (elevated temperature, smoke or the like) is detected by the sensor 34, a command signal is sent to the receiver 35 which passes on a signal to open the water supply to the pipe 40. The evacuation devices 1 thus goes from the standby state over to an activated state, as described in the above, and transports gases (air, smoke and particles) out of the room R. At the same time, and optionally separately controlled, the nebulizing device 39 dispenses nebulized water into the room R. This nebulized water contributes to cooling the gases inside the room. As is shown, the nebulizing device 39 is preferable located at a distance from the evacuation device, so that nebulized water from the nebulizing device is not directly sucked into the evacuation device.

Figure 15:
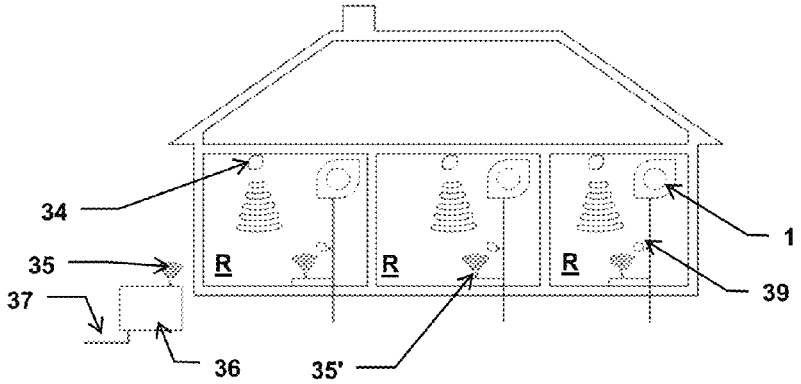
FIG. 15 correspond to FIG. 14 and shows how several systems for evacuating smoke and fighting fire are connected in series.

FIG. 15 shows how several systems for evacuating smoke and fighting fire are connected in series. Each room R is equipped as described above with reference to FIG. 14 and additionally with a local receiver/transmitter 35' for passing on signals from a respective sensor 34 to the receiver 35.

Even though the evacuation device has been described with reference to certain dimensions and operating parameters, the invention is not necessarily limited to these. Further, it is to be understood that the evacuation device is suitable for transporting other gases than smoke.

The invention claimed is:

1. An evacuation device for transporting gas and/or particles out of a room, comprising mounting means for installation in a wall of the room such that an inflow end is located on the face of the wall that faces the inside of the room and an outflow end is located outside the room, the evacuation device comprising:

a venturi nozzle having an inflow portion, an outflow portion and an intermediate tapered portion, and extending between the inflow end and the outflow end, a barrier releasably attached in the venturi nozzle to seal it when the evacuation device is in a standby state, and a plurality of nozzles arranged at the inflow portion to guide at least one flow of fluid through the venturi nozzle when the evacuation device is in an activated state.

2. The evacuation device according to claim 1, wherein the inflow portion is in fluid communication with the inflow end and the outflow portion is in fluid communication with the outflow end.

3. The evacuation device according to claim 2, wherein the plurality of nozzles are located upstream of the tapered portion.

4. The evacuation device according to claim 3, wherein the plurality of nozzles comprise a plurality of water vaporizing nozzles placed in a holder at the inflow to the inflow portion, the water nebulizing nozzles being arranged for fluid communication with a water reservoir.

5. The evacuation device according to claim 3, further comprising an inflow lid for releasably shutting off the inflow end and an outflow lid for releasably shutting off the outflow end when the evacuation device is in a standby state, and activating means to release the inflow and outflow lids when the evacuation device is brought into an activated state.

6. The evacuation device according to claim 2, wherein the barrier comprises an isolating plug adapted to sealingly engage the outflow portion of the venturi nozzle.

7. The evacuation device according to claim 2, wherein the plurality of nozzles are arranged for connection to a liquid reservoir and configured to send nebulized liquid into the venturi nozzle.

8. The evacuation device according to claim 2, wherein the plurality of nozzles comprise a plurality of water vaporizing nozzles placed in a holder at the inflow to the inflow portion, the water nebulizing nozzles being arranged for fluid communication with a water reservoir.

9. The evacuation device according to claim 2, further comprising an inflow lid for releasably shutting off the inflow end and an outflow lid for releasably shutting off the outflow end when the evacuation device is in a standby state, and activating means to release the inflow and outflow lids when the evacuation device is brought into an activated state.

10. The evacuation device according to claim 1, wherein the plurality of nozzles are arranged for connection to a liquid reservoir and configured to send nebulized liquid into the venturi nozzle.

11. The evacuation device according to claim 10, wherein the plurality of nozzles comprise a plurality of water vaporizing nozzles placed in a holder at the inflow to the inflow portion, the water nebulizing nozzles being arranged for fluid communication with a water reservoir.

12. The evacuation device according to claim 1, wherein the plurality of nozzles comprise a plurality of water vaporizing nozzles placed in a holder at the inflow to the inflow portion, the water nebulizing nozzles being arranged for fluid communication with a water reservoir.

13. The evacuation device according to claim 1, further comprising an inflow lid for releasably shutting off the inflow end and an outflow lid for releasably shutting off the outflow end when the evacuation device is in a standby state, and activating means to release the inflow and outflow lids when the evacuation device is brought into an activated state.

14. The evacuation device according to claim 13, wherein the activating means comprise a pressure-actuated plug arranged to be able to be moved by applying pressurised water.

15. The evacuation device according to claim 13, further comprising attachment means for releasable connection of the outflow lid, the barrier and the inflow lid.

16. A system for extinguishing a fire in a room, comprising an evacuation device according to claim 1 and a water nebulizing nozzle, wherein the evacuation device and the water nebulizing nozzle are both placed in a wall and in fluid communication with a water reservoir, and are associated with temperature and/or smoke sensor means, the water reservoir being associated with receiver means arranged for communication with the sensor means for a supply of water from the water reservoir to the evacuation device and the water nebulizing nozzle.

17. An evacuation device for transporting gas and/or particles out of a room, comprising mounting means for installation in a wall of the room such that an inflow end is located on the face of the wall that faces the inside of the room and an outflow end is located outside the room, the evacuation device comprising:

a duct extending between the inflow end and the outflow end;

a barrier releasably attached in the duct to seal it when the evacuation device is in a standby state;

driving means arranged to guide at least one flow of fluid through the duct when the evacuation device is in an activated state; and an inflow lid for releasably shutting off the inflow end and an outflow lid for releasably shutting off the outflow end when the evacuation device is in a standby state, and activating means to release the inflow and outflow lids when the evacuation device is brought into an activated state.

18. The evacuation device according to claim 17, wherein the activating means comprise a pressure-actuated plug arranged to be able to be moved by applying pressurized water.

19. The evacuation device according to claim 17, further comprising attachment means for releasable connection of the outflow lid, the barrier and the inflow lid.

* * * * *